US005086948A

United States Patent [19]

Slusarz

[11] Patent Number: 5,086,948

[45] Date of Patent: Feb. 11, 1992

[54] TENNIS BALL PACK DISPENSING AND RETRIEVING APPARATUS

[76] Inventor: Bennet A. Slusarz, 645 10th St., Hermosa Beach, Calif. 90254

[21] Appl. No.: 621,982

[22] Filed: Dec. 4, 1990

[51] Int. Cl.[5] ..... A47F 1/08

[52] U.S. Cl. ..... 221/185; 221/309; 221/281; 294/19.2; 273/29 R; 273/32 F

[58] Field of Search ..... 221/185, 303, 307, 309, 221/34, 35, 61, 63, 281; 294/19.2; 224/196, 210, 211; 273/29 R, 32 F

[56] References Cited

U.S. PATENT DOCUMENTS

| | | | |
|---|---|---|---|
| 611,172 | 9/1898 | Jackson | 221/185 |
| 3,804,449 | 4/1974 | Falitz | 294/19.2 |
| 3,889,996 | 6/1975 | Campbell | 294/19.2 |
| 4,088,251 | 5/1978 | Rodriguez | 221/303 X |
| 4,811,980 | 3/1989 | Ferrari et al . | 294/19.2 |
| 4,860,936 | 8/1989 | Lowe | 224/196 X |

FOREIGN PATENT DOCUMENTS 460460 1/1937 United Kingdom .

*Primary Examiner*—D. Glenn Dayoan
*Assistant Examiner*—Dean A. Reichard
*Attorney, Agent, or Firm*—Melvin A. Klein

[57] ABSTRACT

A tennis ball pack apparatus for dispensing balls in one mode of operation while positioned on a player's back and retrieving balls in another mode of operation upon removal from the back. An elongated housing which is strapped to the player's back includes two pairs of spaced walls which have different lengths to define predetermined openings adjacent to an oblong shaped bottom made up of flexible connected rod members. During the ball dispensing mode the player grips a ball through an opening and pulls against the flexible rod members to dispense the balls in seriatim. A U-shaped frame which is in slidable engagement with the walls of the housing is movable from a first position closely adjacent to the housing when operating in the ball dispensing mode while on the player's back to a second position extended from the housing when operating in a ball retrieving mode upon removal of the housing from the player's back.

12 Claims, 3 Drawing Sheets

TENNIS BALL PACK DISPENSING AND RETRIEVING APPARATUS

BACKGROUND OF THE INVENTION

1. Field of the Invention

The field of art to which this invention pertains is a tennis ball pack apparatus for dispensing balls in one mode of operation while positioned on a player's back and retrieving balls in another mode of operation upon removal.

2. Description of Prior Art

It is well known to provide devices for carrying and/or picking up tennis balls. Such devices are widely used by instructors as well as by players. Examples of such devices are hoppers made of wire construction which are hand carried and lifted to a desired place on the tennis court. These hoppers carry as many as 75 to 100 balls and can be used to pick stray balls by positioning them over the balls and pressing the ball or balls against the wire construction. Another transport device is a cart that can hold twice as many balls and is pushed around the court. Alternatively, a ball retaining device may be worn by the player. One such device is a zippered pack worn around the player's waist. These prior art devices have been found to be lacking in the sense that they are either bulky or awkward to move from place to place by the player or instructor while teaching. In the case of the zippered pack the player or instructor does not have ease of access to a large number of balls expediently or a convenient way for picking up the tennis balls.

SUMMARY OF THE INVENTION

In accordance with present invention a ball pack dispensing and retrieving apparatus is provided having an elongated housing for storing tennis balls while positioned on a player's back including a first pair of spaced walls having a relatively narrow spacing which is at least the diameter of a tennis ball, and a second pair of spaced walls having a spacing coextensive with a player's back, and an oblong shaped bottom including flexible rod members for supporting tennis balls, at least some of the rod members being sufficiently displacable upon flexing thereof enabling balls to be forcibly inserted between the rod members. The second pair of walls extends for a predetermined length which is less than the first pair of walls to define at least one opening adjacent to the bottom at the ends thereof enabling balls to be dispensed through the opening in seriatim by gripping a ball and imparting a predetermined force against the bottom. A U-shaped frame extends across the top of the housing and downwardly in close proximity with the second pair of walls, said frame is slidable in engagement with the second pair of walls from a first position adjacent to the housing when operating in a ball dispensing mode while on the player's back to a second position extended from the housing when operating in a ball retrieving mode upon removal of the housing from the player's back.

A particularly important part of the invention is that a player or instructor is able to dispense balls quickly and easily while the housing is straped to him or her. On the other hand the compact apparatus does not interfere with movement or impede play. Upon removal of the apparatus from the player's back and movement into its extended second position, the apparatus can be operated in a ball retrieving mode of operation in which balls are retrieved through the bottom of the housing.

Another aspect of the invention is that the apparatus is made from light weight materials and is comfortably fitted and compact so that it may be easily carried around by the player or instructor during play. This is particularly important because of the long time spent on the court during playing or teaching. Furthermore due to the unique construction of the apparatus there is no obstruction during play while straped to the user during the dispensing mode while enabling rapid and convenient dispensing of the balls in seriatim as desired.

DESCRIPTION OF THE PREFERRED EMBODIMENT

Figure 1:
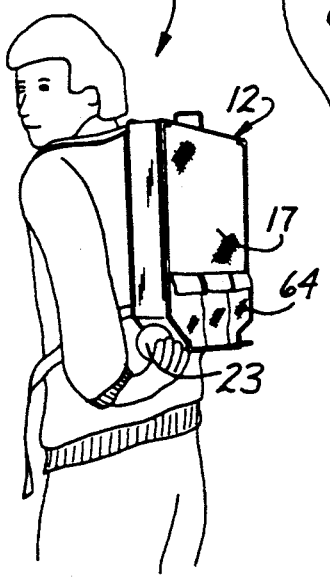
FIG. 1 is a perspective view of the ball pack dispensing and retrieving apparatus attached to the back of the user illustrating the dispensing mode of operation according to the present invention.

Referring now to FIG. 1 there is shown the ball pack dispensing and retrieving apparatus generally designated 10 which is attached to the back of the instructor or player 11 during the ball dispensing mode of operation. Referring to FIGS. 2–6 apparatus 10 includes an elongated housing 12 having a frame 14 supporting walls 16, 17, 18, and 20, and an oblong shaped bottom 22 for the storage of tennis balls 23. Walls 16 and 17 are made out of any suitable light weight flexible material, such as, nylon, and are secured to the frame 14 in any suitable manner known by those skilled in the art, such as, by adhesive, stitching, rivets, screws, or the like. Desirably walls 16 and 17 can be stiffened by insertion of cardboard member 25 or the like (FIG. 6). It will be appreciated that walls 16 and 17 have a relatively narrow spacing which is slightly more than the diameter of a tennis ball to facilitate the loading and dispensing of tennis balls as will become more apparent hereinafter.

Figure 5:
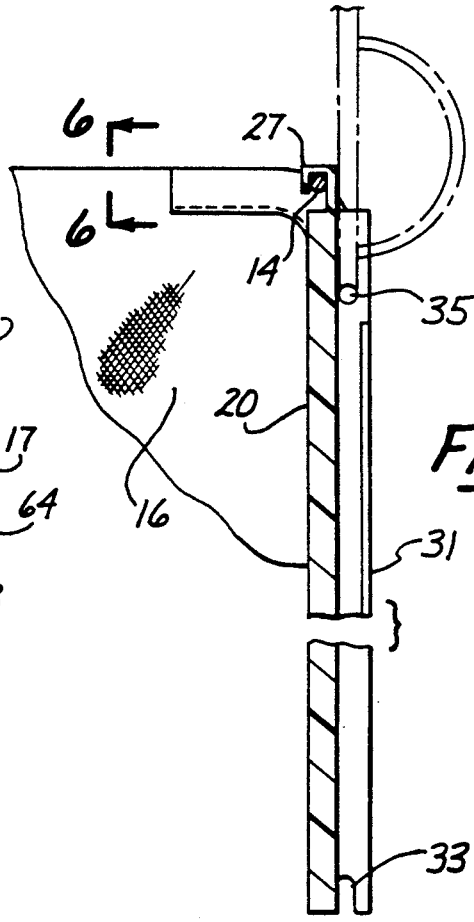
FIG. 5 is partial sectional view taken along lines 5-5 in FIG. 3.
Figure 6:
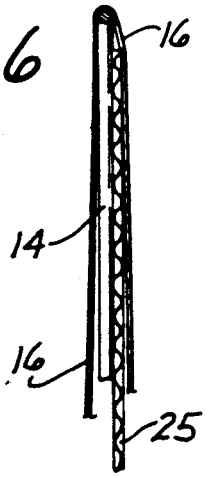
FIG. 6 is a partial sectional view illustrating certain details of construction of a wall.
Figure 4:
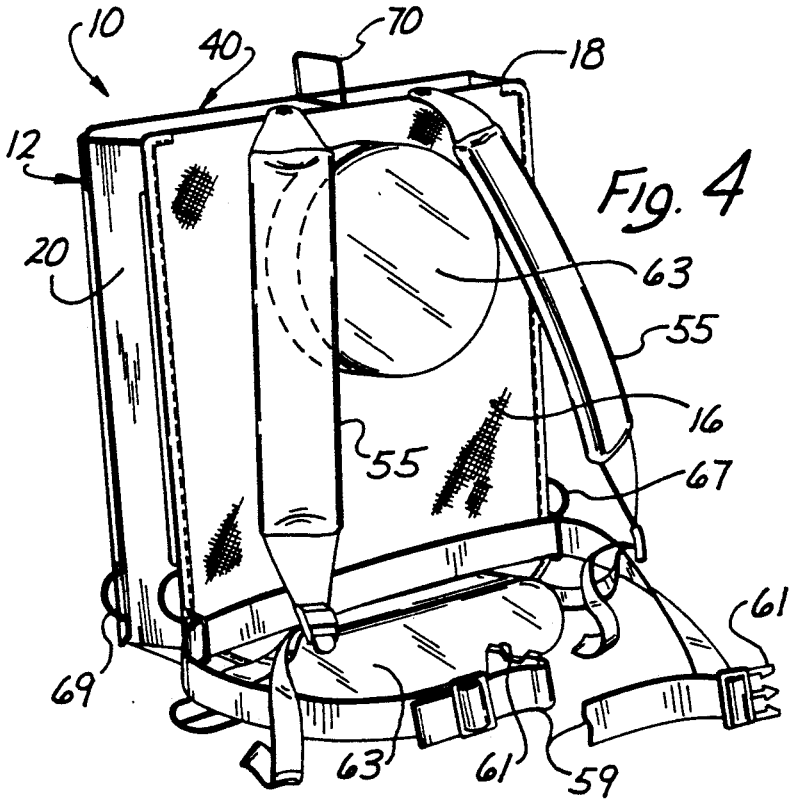
FIG. 4 is another view of the apparatus illustrating still other details thereof.
Figure 2:
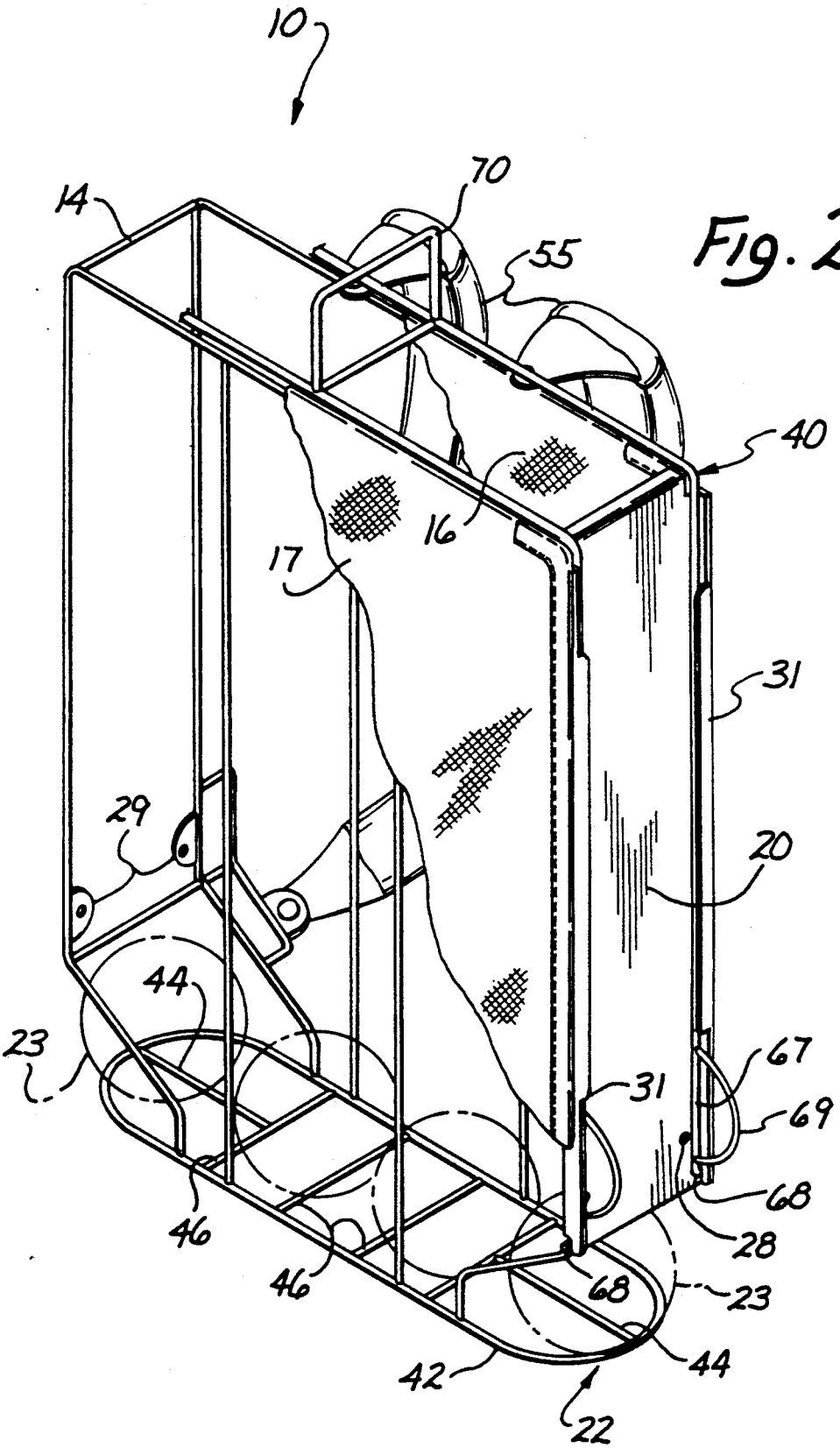
FIG. 2 is an enlarged perspective view of the apparatus partly in section illustrating certain details of the invention.
Figure 3:
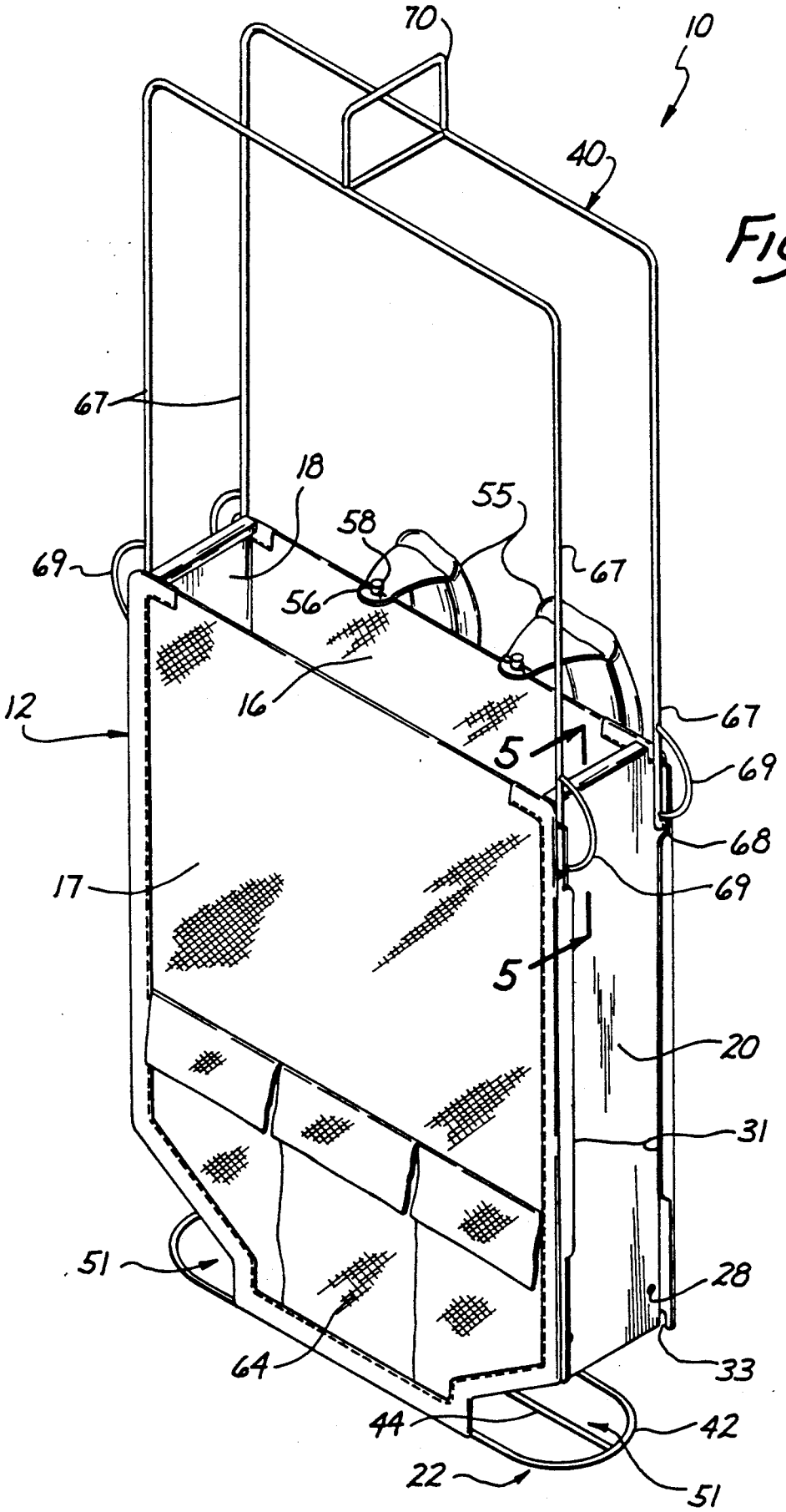
FIG. 3 is a another view of the apparatus illustrating the ball retrieving mode of operation.

Walls 18 and 20 are made out any suitable relatively rigid light weight materials, such as, plastic, and are secured to frame 14 by hooking the tops around frame 14 by the use of hook portions 27 extending from the walls (FIG. 5). The opposite ends of the walls 18 and 20 are secured to frame 14 in any suitable manner as by screws 28 received in brackets 29 extending from frame 14. It will be appreciated the spacing between walls 18 and 20 is coextensive with the back of player 11.

It will be noted that walls 18 and 20 are formed with planar guide portions 31 which extend outwardly from the walls. At the bottom each of the guide portions 31 is formed with a recess opening 33 and adjacent to the top each of the guide portions is formed with a small opening 35. Guide portions 31 and openings 33 and 35 provide a surface for sliding engagement with a U-shaped frame member 40 that is movable relative to the housing as will become more apparent hereinafter.

Bottom 22 of the housing includes flexible rod members which are made up of an oblong shaped member 42 with curved ends, longitudinally extending members 44, and cross members 46 extending at right angles to the longitudinal axis of bottom 22. It will be appreciated that cross members 46 have sufficient flexibility and displacement to enable a tennis ball to be inserted therebetween when a sufficient force is exerted thereon enabling balls to be retrieved through the bottom 22 during the retrieving mode of operation as will become more apparent hereinafter.

It will be noted that openings 51 having a predetermined size and shape are formed at the lower sides of the housing between the bottom edges of walls 18 and 20 and bottom 22. The height of opening 51 is slightly less than the diameter of a tennis ball. During the dispensing mode of operation tennis balls 23 are dispensed through the opening 51 by the player gripping the ball and pulling against bottom 22 thereby releasing the ball from the housing due to the flexibility at the curved ends of member 42. Gripping the ball is made possible by the opening provided at the bottom of the walls. Thus the lower edge of walls 16 and 17 extends horizontally from the center towards the ends, then extends vertically, and then inclines upwardly providing sufficient space for gripping the balls at the bottom on the ends. During the dispensing mode a player can dispense balls in seriatim upon gripping and pulling the ball located at one of the openings 51 against the spring action provided by flexible rod members 42, 44, and 46 of bottom 22. Due to gravity tennis balls stored in the housing will advance towards openings 51 located at the bottom of the housing.

In accordance with the invention apparatus 10 has two modes of operation. One mode is the ball dispensing mode when the apparatus is carried on the back of the player or instructor. Shoulder strap members 55 are secured to the frame 14 in any suitable manner as by pins 56 received through bolts 58 on frame 14 which receive the strap members. Similarly waist strap members 59 are threaded through frame 14 to provide fastening around the waist of the player. Strap members 59 can be fastened in any suitable manner as by the use of a snap members 61 and are adjustable in a manner well known by those skilled in the art. To facilitate carrying apparatus 10 wall 16 is formed with one or more pads 63. Also one or more pouches 64 are formed in wall 17 for carrying personal items.

Apparatus 10 has a second mode of operation for retrieving tennis balls. For this mode after removal of the housing 12 from the back of the player, a U-shaped rod member 40 is moved from a first position in close proximity to the housing to a second position extended from the housing. U-shaped member 40 extends across the top of the housing and then downwardly along the sides of the housing and includes a pair of displaceable leg members 67 which have outwardly extending end portions 68 which engage openings 33 in planar portions 31 during the ball dispensing mode. Adjacent to end portions 68 the leg members 67 are formed with curved portions 69. Upon pressing curved portions 69 together, end portions 68 are disengaged from planar portions 31 and member 40 can be moved upwardly with end portions 68 in sliding engagement with planar portions 31 until end portions 68 are received in openings 35 formed in planar portions 31. It will now be appreciated that tennis balls can be retrieved by gripping a handle portion 70 of member 40 and pressing bottom 22 against loose balls on the ground thereby refilling the housing with tennis balls.

By the above described invention a ball pack dispensing and retrieving apparatus is provided which enables a player or instructor to carry and dispense a relatively large supply of tennis balls during play in one mode of operation and to retrieve the loose balls during another mode of operation. By virtue of the unique light weight construction and operation of the apparatus, a novel dispensing and retrieving of tennis balls is provided for the instructor or player wanting to improve his or her game.

The principles, preferred embodiment, and modes of operation of the present invention have been described in the foregoing specification. The invention which is intended to be protected herein, however, is not to be construed as limited to the particular forms disclosed, since these are regarded as illustrative rather than restrictive. Variations and changes may be made by those skilled in the art without departing from the spirit of the invention.

What is claimed is:

1. Ball pack apparatus for dispensing and retrieving tennis balls comprising, an elongated housing for storing tennis balls while positioned on a player's back including a first pair of spaced walls having a relatively narrow spacing which is at least the diameter of a tennis ball, and a second pair of spaced walls having a spacing larger than said relatively narrow spacing;

said housing having an oblong shaped bottom for supporting tennis balls including a plurality of flexible connected rod members, at least some of said rod members being sufficiently displaceable upon flexing thereof enabling balls to be forcibly inserted therebetween;

said second pair of walls extending for a predetermined length which is less than said first pair to define at least one opening adjacent to the bottom at the ends thereof enabling balls to be dispensed through the opening in seriatim by gripping a ball and imparting a predetermined force against the bottom; and a U-shaped frame extending across the top of said housing and downwardly in close proximity with said second pair of walls, said U-shaped frame being slidable in engagement with said second pair of walls from a first position adjacent to the housing when operating in a ball dispensing mode while on the player's back to a second position extended from the housing when operating in a ball retrieving mode upon removal of the housing from said player's back.

2. Apparatus according to claim 1 wherein said second pair of walls have planar portions extending outwardly therefrom defining guides for guiding the movement of the U-shaped frame.

3. Apparatus according to claim 2 wherein said U-shaped frame includes parallel spaced displacable leg members having end portions terminating outwardly, said end portions being movable inwardly out of engagement with openings formed in said planar portions.

4. Apparatus according to claim 1 wherein said first pair of walls have bottom edges that extend horizontally from the center towards the ends thereof, then vertically, and then incline upwardly.

5. Apparatus according to claim 1 wherein said bottom has a curved portion at the ends thereof, said curved portion being connected to a longitudinally extending rod member.

6. Apparatus according to claim 5 wherein said bottom has a plurality of said rod members that extend at right angles to its longitudinal axis.

7. Apparatus according to claim 1 wherein said housing has a plurality of strap members secured thereto for attaching said housing to the back of a person during the ball dispensing mode.

8. Apparatus according to claim 1 wherein said first pair of walls are made of light weight flexible material.

9. Apparatus according to claim 1 wherein said second pair of walls are made of relatively rigid light weight material.

10. Apparatus according to claim 8 wherein a one of said first pair of walls has at least one support pad attached thereto.

11. Apparatus according to claim 8 wherein a one of said first pair of walls has at least one storage pocket formed therein.

12. Apparatus according to claim 8 wherein said first pair of walls has a stiffening member positioned therein.

* * * * *